US007318369B1

(12) United States Patent
Madigan et al.

(10) Patent No.: US 7,318,369 B1
(45) Date of Patent: Jan. 15, 2008

(54) OUT-OF-BATTERY LOCK FOR AUTOMATIC PRIMER FEED MECHANISM

(75) Inventors: Lisa J. Madigan, Melrose, NY (US); Robert J. Mysliwiec, East Greenbush, NY (US); Vincent J. Olmstead, Waterford, NY (US)

(73) Assignee: United States of America as represented by the Secretary of the Army, Washington, DC (US)

( * ) Notice: Subject to any disclaimer, the term of this patent is extended or adjusted under 35 U.S.C. 154(b) by 491 days.

(21) Appl. No.: 10/908,078

(22) Filed: Apr. 27, 2005

(51) Int. Cl.
*F41A 19/00* (2006.01)

(52) U.S. Cl. ..... 89/27.13; 89/27.11

(58) Field of Classification Search ..... 89/27.13, 89/27.11
See application file for complete search history.

(56) References Cited

U.S. PATENT DOCUMENTS

| | | | | |
|---|---|---|---|---|
| 1,091,638 | A * | 3/1914 | Dawson et al. | 89/27.13 |
| 1,095,558 | A * | 5/1914 | Dawson et al. | 89/27.13 |
| 1,415,044 | A * | 5/1922 | Nusbaum | 89/28.05 |
| 3,951,041 | A * | 4/1976 | Bartolles | 89/27.13 |
| 4,991,490 | A * | 2/1991 | Balbo et al. | 89/24 |
| 5,115,716 | A * | 5/1992 | Doering et al. | 89/25 |
| H1121 | H * | 12/1992 | Carroll et al. | 89/27.13 |
| 5,331,880 | A * | 7/1994 | Bartolles | 89/24 |
| 7,228,779 | B2 * | 6/2007 | Van Dyke-Restifo et al. | 89/27.13 |
| 7,246,549 | B1 * | 7/2007 | Van Dyke-Restifo et al. | 89/27.13 |
| 2005/0217469 | A1 * | 10/2005 | Van Dyke-Restifo et al. | 89/33.14 |
| 2007/0151439 | A1 * | 7/2007 | Van Dyke-restifo et al. | 89/27.13 |

* cited by examiner

*Primary Examiner*—Victor Batson
*Assistant Examiner*—Michael D. David
(74) *Attorney, Agent, or Firm*—John F. Moran

(57) ABSTRACT

An out-of-battery lock for a primer feed mechanism having a drive shaft and a drive shaft housing surrounding the drive shaft, the out-of-battery lock including a housing having an opening therethrough for attachment to the drive shaft; a pair of wings disposed on opposite sides of the housing; a plunger slot formed in the housing; a plunger movably disposed in the plunger slot, the plunger including a central bore therein and a pair of tabs disposed on opposite sides of the plunger; and a compression spring disposed in the central bore in the plunger, the compression spring providing a force to bias the plunger towards the drive shaft housing.

10 Claims, 7 Drawing Sheets

OUT-OF-BATTERY LOCK FOR AUTOMATIC PRIMER FEED MECHANISM

FEDERAL INTEREST STATEMENT

The inventions described herein may be manufactured, used and licensed by or for the U.S. Government for U.S. Government purposes.

BACKGROUND OF THE INVENTION

The invention relates in general to primer feed mechanisms for artillery cannon and, in particular, to a device to prevent movement of a primer feed mechanism during recoil of the cannon.

Cannon may be equipped with a primer feed mechanism of the type having a movable tray, such as disclosed, for example, in copending U.S. patent application Ser. No. 10/907,911 filed on Apr. 20, 2005 entitled "Automatic Primer Feed Mechanism," which application is hereby expressly incorporated by reference. One problem with such a primer feed mechanism is that, during recoil, the external power driver (hereinafter "handle") for the primer feed mechanism is disengaged. Because the handle is disengaged, certain components of the primer feed mechanism, such as the tray, may continue to move due to acceleration forces. Continued movement of the tray may result in premature extraction of the primer and/or damage to the mating components once the cannon returns to battery.

SUMMARY OF THE INVENTION

The present invention provides a locking device for the tray of a primer feed mechanism. The locking mechanism restrains tray movement when the cannon is recoiling and the handle is disengaged from the primer feed mechanism. During recoil movement of the cannon, the position of the cannon is known as "out-of-battery." The position of the cannon when at rest and ready to fire is "in-battery." Because the invention provides a locking function during recoil of the cannon, the invention is termed an out-of-battery lock (hereinafter "OBL").

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
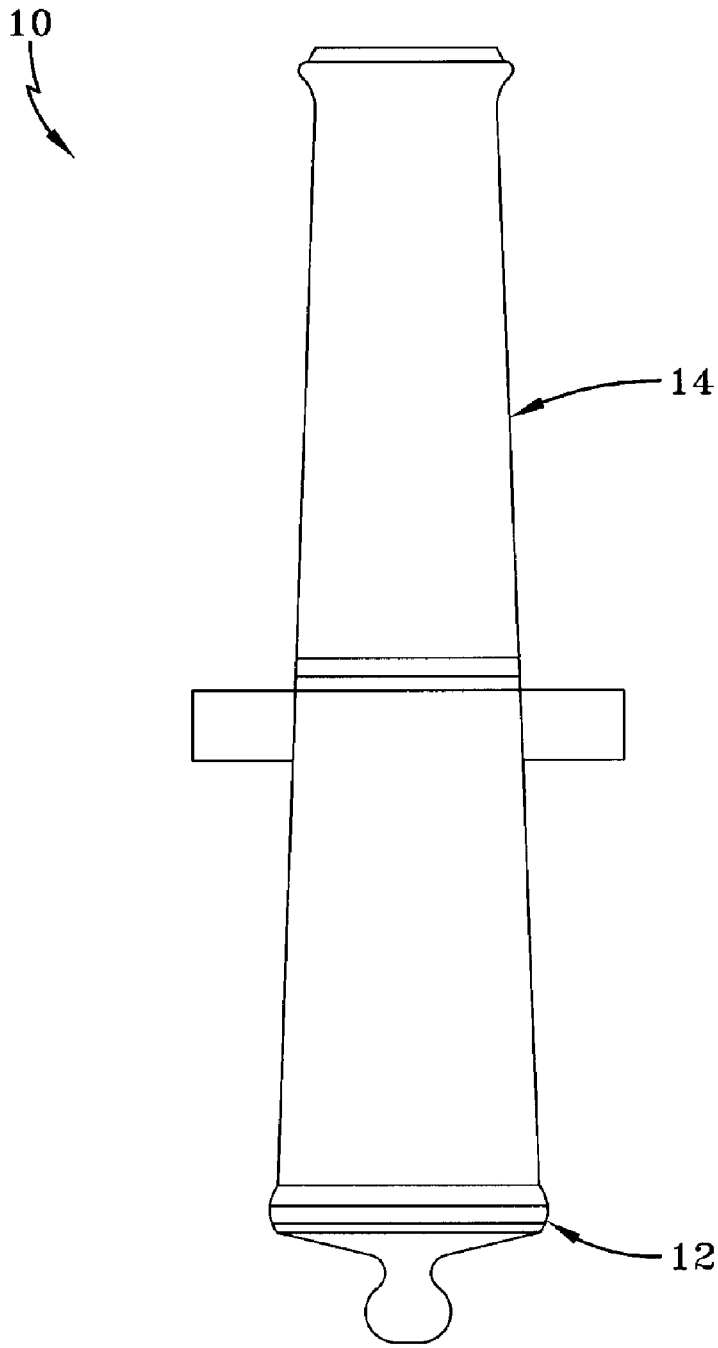
FIG. 1 is a top view of an artillery gun.
Figure 2:
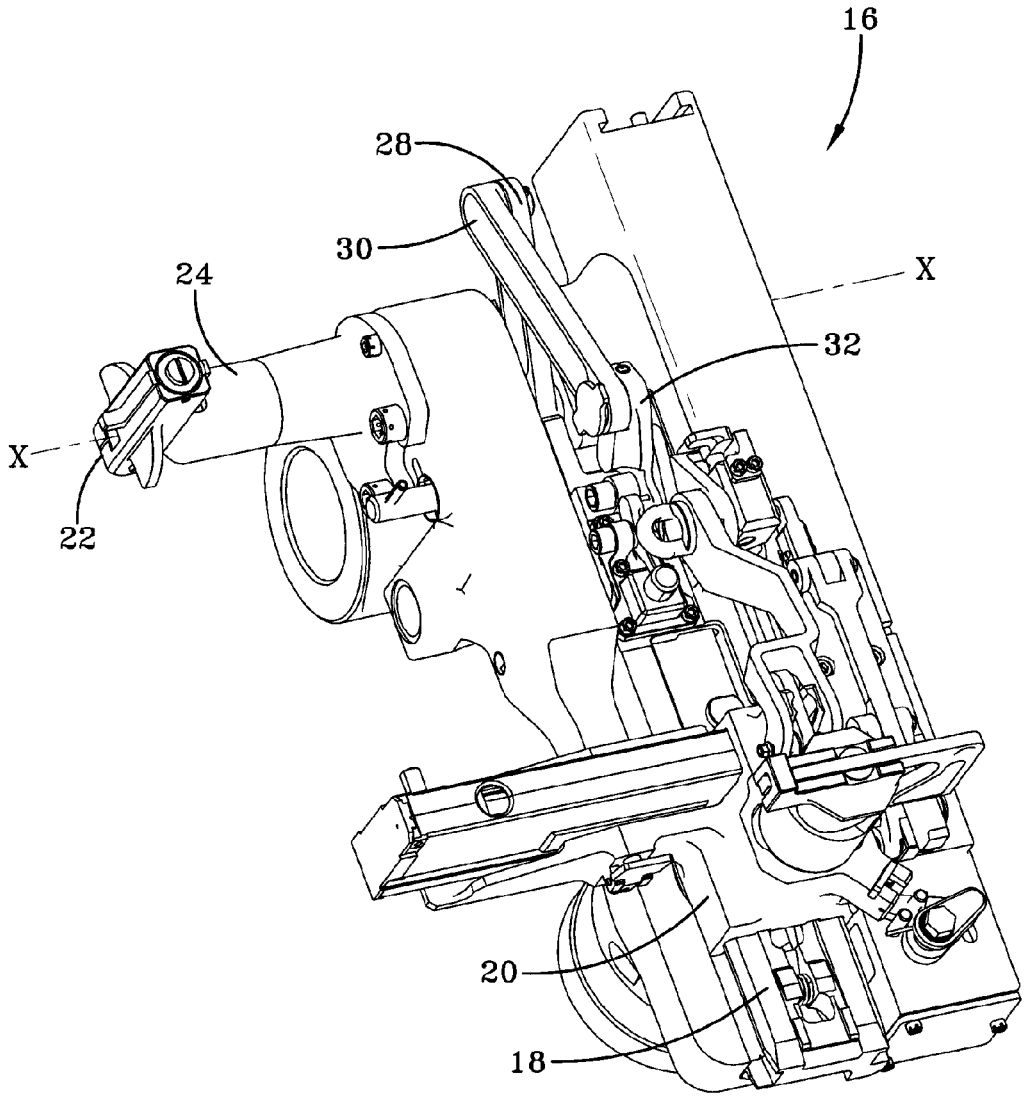
FIG. 2 is a perspective view of a carrier assembly.

FIG. 1 is a top view of an artillery gun or cannon 10. Gun 10 includes a breech 12, shown in a closed position, aligned with a barrel 14. When the breech 12 is in an open position, munitions may be loaded into a firing chamber of barrel 14. When the breech 12 is in a closed position, the munitions may be fired. FIG. 2 is a perspective view of a carrier 16 that forms part of the breech 12. Mounted on the carrier assembly 16 is a primer feed mechanism. The primer feed mechanism includes a body 18 attached to the carrier 16 and a tray 20 that is axially movable with respect to the body 18. In FIG. 2, the tray 20 is in the firing position. It is a purpose of the out-of-battery lock of the present invention to maintain the tray 20 in the firing position as the gun 10 recoils after firing.

Figure 6:
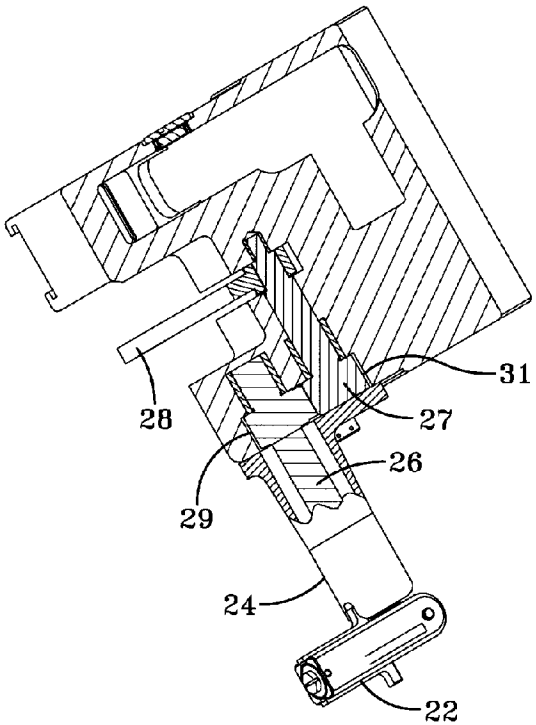
FIG. 6 is a sectional view taken along the line E-E of FIG. 5.
Figure 5:
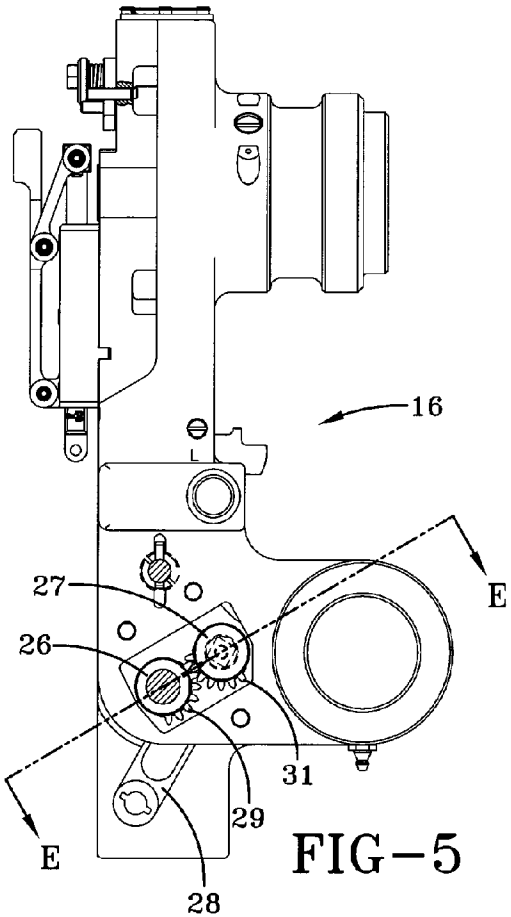
FIG. 5 is a sectional side view taken along the line D-D of FIG. 4.

Referring again to FIG. 2, drive shaft housing 24 houses a drive shaft 26 (FIGS. 5 and 6). The out-of-battery lock (OBL) 22 is mounted on an end of drive shaft 26 that extends out of drive shaft housing 24. An external power driver (handle) (not shown) engages OBL 22 and causes OBL 22 to rotate about a longitudinal axis X-X of the drive shaft 26. Because OBL 22 is fixed to an end of drive shaft 26, drive shaft 26 rotates when OBL 22 rotates. Drive shaft 26 drives a link shaft 27 (FIG. 6). Link shaft 27 drives actuator link 28. Actuator link 28 drives a quick release link 30 that drives a drive link assembly 32. Drive link assembly 32 drives axial movement of tray 20. Thus, to prevent movement of tray 20, it is necessary to prevent rotation of drive shaft 26.

When the cannon 10 is at rest (in-battery position), the handle is engaged with OBL 22 and controls movement of the tray 20. However, when the cannon is fired and recoils (out-of-battery position), the handle disengages from the OBL 22. To prevent further movement of the tray 20 in the out-of-battery position, the OBL 22 is "locked" to prevent its rotation and rotation of the drive shaft 26 to which it is fixed. After recoil, the cannon returns to the in-battery position. The handle reengages the OBL 22 and "unlocks" the OBL 22. The manner of locking and unlocking the OBL 22 is discussed in more detail below.

Figure 4:
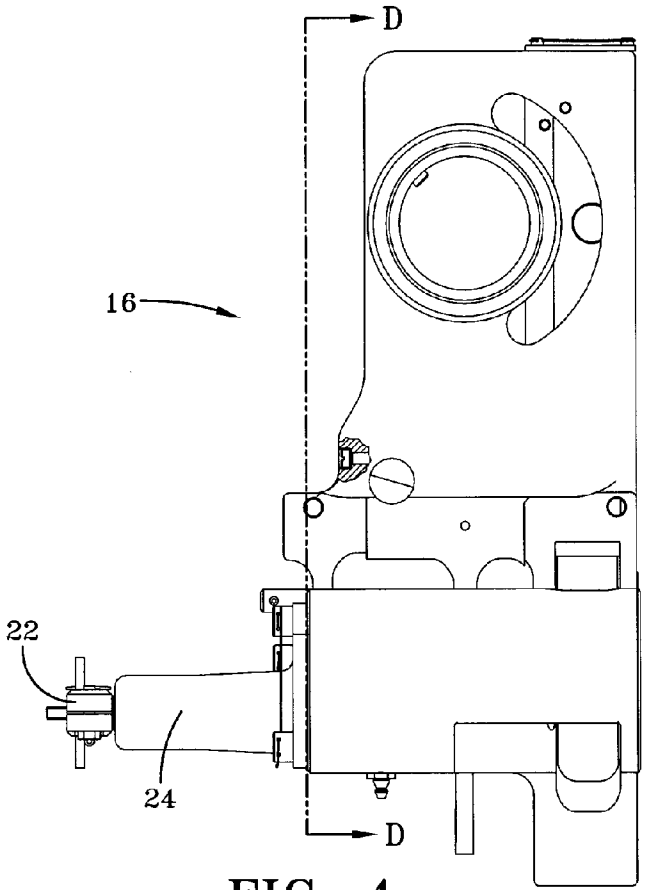
FIG. 4 is an end view of FIG. 3.
Figure 3:
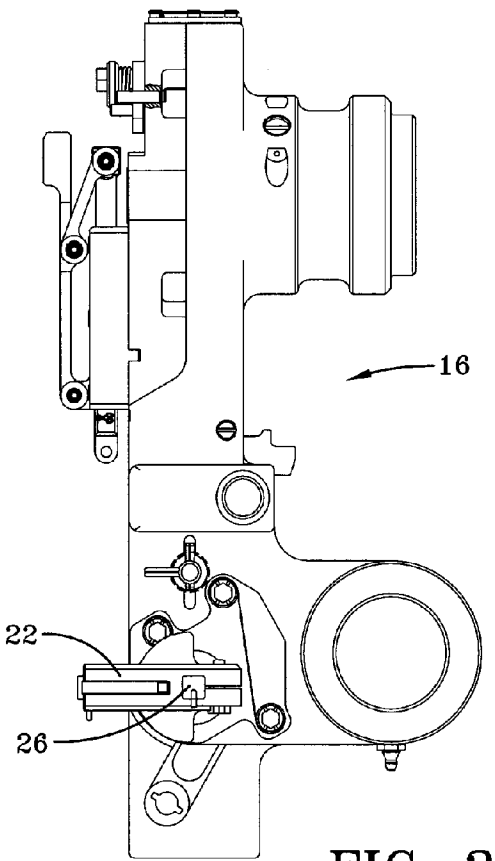
FIG. 3 is a side view of a carrier.

FIGS. 3-6 illustrate the connections from the OBL 22 to the actuator link 28. FIG. 3 is a side view of the carrier 16 with some components removed for clarity. FIG. 4 is an end view of FIG. 3. FIG. 5 is a sectional side view taken along the line D-D of FIG. 4 and FIG. 6 is a sectional view taken along the line E-E of FIG. 5. As best seen in FIGS. 5 and 6, OBL 22 is fixed to an end of drive shaft 26 that extends beyond drive shaft housing 24. The other end of drive shaft 26 includes gearing 29 that meshes with gearing 31 on link shaft 27. Actuator link 28 is fixed to link shaft 27. Thus, rotation of OBL 22 causes movement of actuator link 28.

Figure 7B:
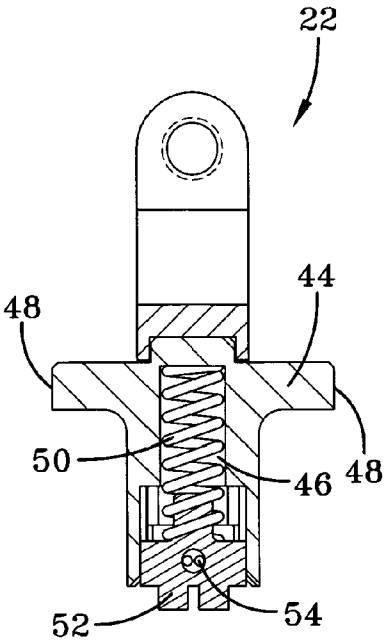
FIG. 7B is a sectional view of an out-of-battery lock taken along the line B-B of FIG. 7.
Figure 7A:
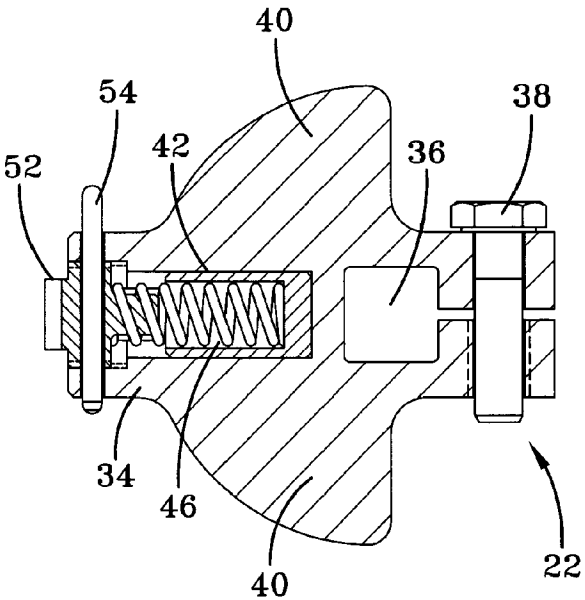
FIG. 7A is a sectional view of an out-of-battery lock taken along the line A-A of FIG. 7.
Figure 7:
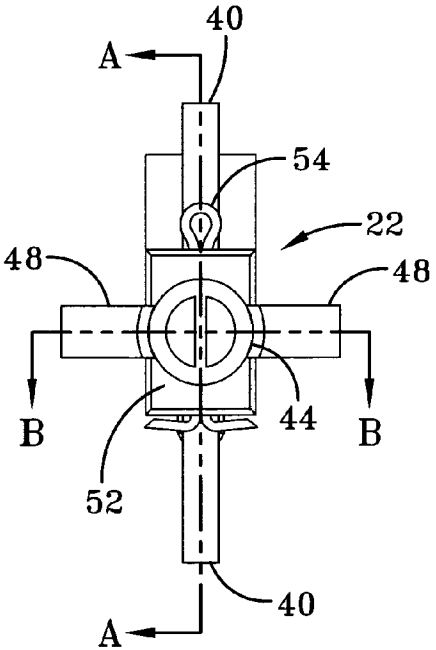
FIG. 7 is an end view of an out-of-battery lock.
Figure 7C:
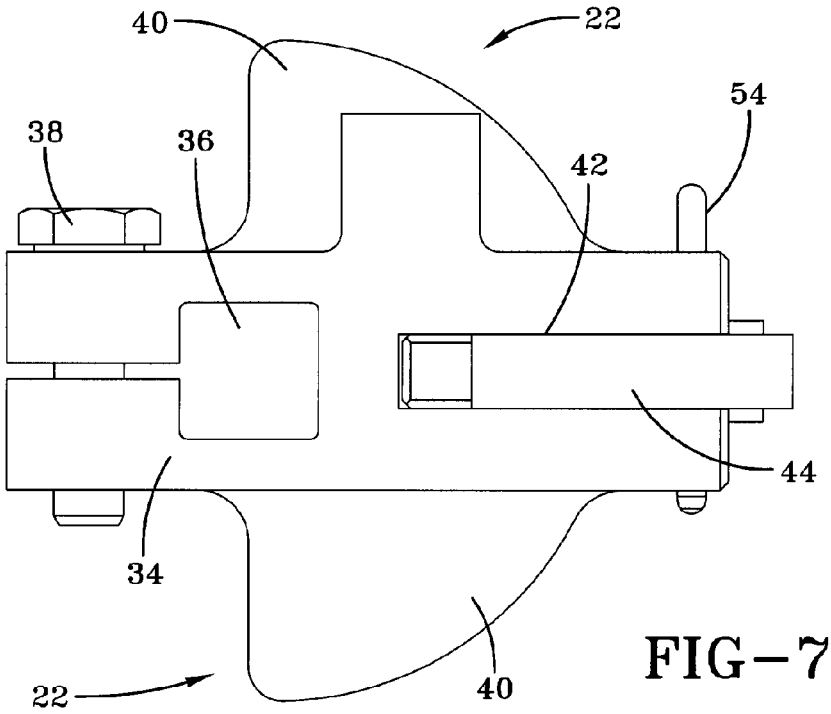
FIG. 7C is a side view of an out-of-battery lock.
Figure 7D:
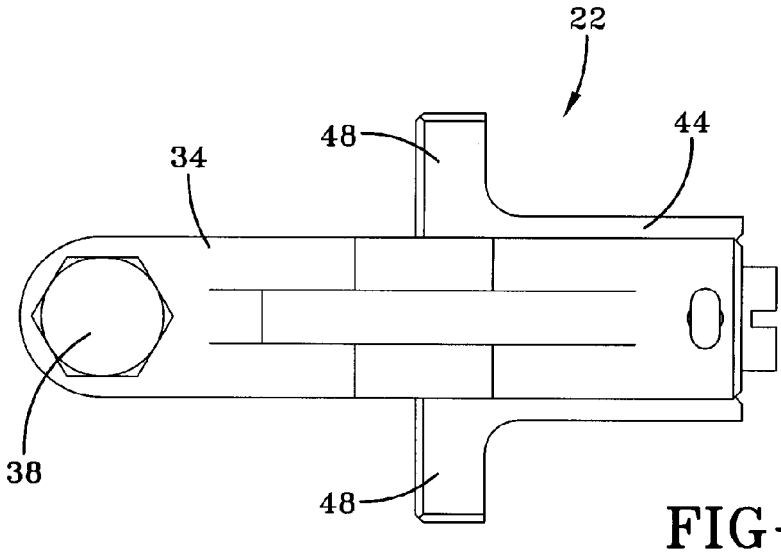
FIG. 7D is a top view of an out-of-battery lock.

FIGS. 7-7D show the OBL 22 in detail. FIG. 7 is an end view of the OBL 22. FIG. 7A is a sectional view of FIG. 7 taken along the line A-A. FIG. 7B is a sectional view of FIG. 7 taken along the line B-B. FIG. 7C is a side view of the OBL 22 and FIG. 7D is a top view of the OBL 22. OBL 22 comprises a housing 34 with an opening 36 therethrough. Opening 36 receives the end of drive shaft 26 that extends beyond drive shaft housing 24. Opening 36 preferably has a generally square shape. Housing 34 is tightened around drive shaft 26 with cap screw 38. Housing 34 includes a pair of wings 40 disposed opposite each other. The handle (not shown) engages wings (flats) 40 to rotate OBL 22 and consequently, rotate drive shaft 26.

The OBL housing 34 has a plunger slot 42 formed therein. A plunger 44 is movably disposed in the plunger slot 42. The plunger 44 has a central bore 46 formed therein. A compression spring 50 is disposed in the central bore 46 of the plunger 44. The compression spring 50 biases the plunger 44 towards the drive shaft housing 24. A retainer 52 and cotter pin 54 hold the plunger 44 and compression spring 50 in the OBL housing 34. A pair of tabs 48 are disposed on opposite sides of the plunger 44. Insertion of one of the tabs 48 into a tab slot 56 in the drive shaft housing 24 (FIG. 8C) locks the OBL 22 when the cannon is out-of-battery. The handle that engages the OBL 22 after recoil unlocks the OBL 22 by engaging the other tab 48 and moving the plunger 44 away from the drive shaft housing 24. As best seen in FIG. 7, the plane of the wings 40 and the plane of the tabs 48 are substantially orthogonal to each other.

Figure 8A:
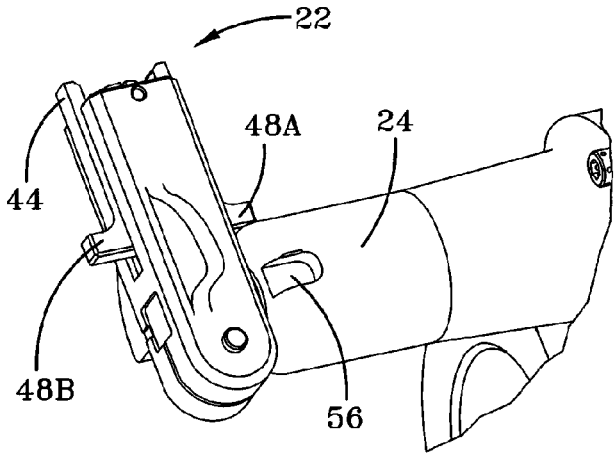
FIGS. 8A-8C show the out-of-battery lock in varying positions.
Figure 8B:
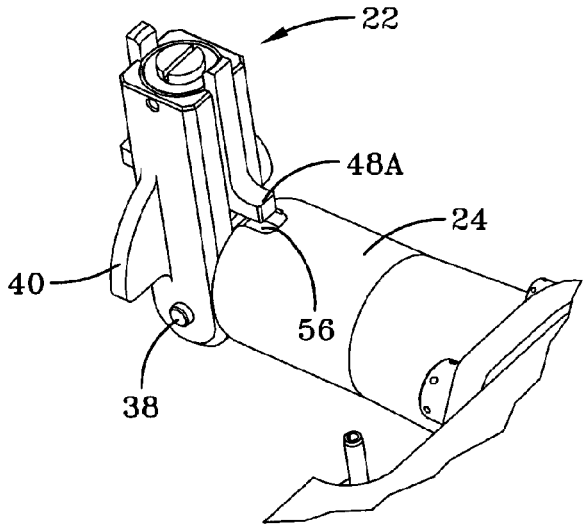
Figure 8C:
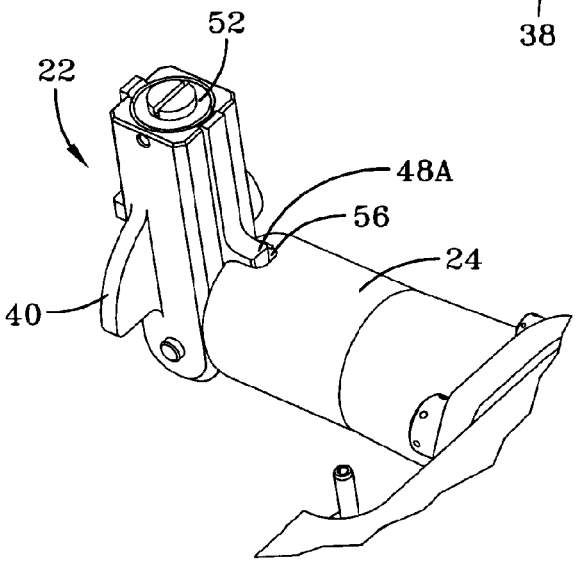

FIGS. 8A-8C show the OBL 22 in unlocked and locked positions. In FIG. 8A, the cannon is in-battery, at rest, and the primer feed mechanism is extracting a fired primer from the cannon. The handle (not shown) mates with and unlocks the OBL 22 and controls its rotation. Drive shaft housing 24 includes a tab slot 56 which receives tab 48A to lock the OBL 22 during recoil of the cannon. In FIG. 8B, the cannon is in-battery, at rest, and ready to fire. The handle still engages the OBL 22, which has rotated to a position wherein the tab 48A is directly above the tab slot 56. When the cannon is fired and recoils, the handle disengages from the OBL 22. FIG. 8C shows the OBL 22 during recoil. The tab 48A engages tab slot 56 due to the force of compression spring 50. OBL 22 is locked and cannot rotate. Because OBL 22 cannot rotate, drive shaft 26 cannot rotate. Thus, actuator link 28, quick release link 30, drive link assembly 32 and the tray 20 are fixed in position.

After recoil, the cannon returns to the in-battery, at rest position. The handle again mates with OBL 22. As the handle engages OBL 22, it also engages tab 48B (FIG. 8A) to force the plunger 44 away from drive shaft housing 24 so that tab 48A no longer engages tab slot 56. Thus, the handle can now rotate OBL 22. Rotation of OBL 22 allows movement of the primer feed mechanism components that are linked to the OBL 22, such as the actuator link 28, quick release link 30, drive link assembly 32 and the tray 20. The cycle is repeated for each firing. Each time the cannon recoils, the handle disengages from the OBL 22 and the tab 48A becomes locked in the tab slot 56 until the handle reengages the OBL 22 and moves the plunger 44 away from the drive shaft housing 24.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An out-of-battery lock for a primer feed mechanism having a drive shaft and a drive shaft housing surrounding the drive shaft, the out-of-battery lock comprising:

a housing having an opening therethrough for attachment to the drive shaft;

a pair of wings disposed on opposite sides of the housing;

a plunger slot formed in the housing;

a plunger movably disposed in the plunger slot, the plunger including a central bore therein and a pair of tabs disposed on opposite sides of the plunger; and a compression spring disposed in the central bore in the plunger, the compression spring providing a force to bias the plunger towards the drive shaft housing.

2. The out-of-battery lock of claim 1 wherein the drive shaft housing includes a tab slot formed therein and further wherein one of the pair of tabs of the plunger engages the tab slot in an out-of-battery position.

3. The out-of-battery lock of claim 1 wherein the opening in the housing has a generally square shape.

4. The out-of-battery lock of claim 1 wherein a plane containing the pair of wings and a plane containing the pair of tabs are substantially orthogonal to each other.

5. The out-of-battery lock of claim 1 further comprising a retainer attached to the housing for holding the plunger and spring in the plunger slot.

6. In a cannon having a breech at one end, an apparatus comprising:

a carrier mounted on the breech, the carrier having a drive shaft housing;

a drive shaft disposed in the drive shaft housing, the drive shaft housing including a tab slot formed in one end thereof;

a link shaft geared to the drive shaft, an actuator link connected to the link shaft, a quick release link connected to the actuator link, a drive link assembly connected to the quick release link and a tray connected to the drive link assembly; and an out-of-battery lock fixed to one end of the drive shaft, the out-of-battery lock including a housing having an opening therethrough for attachment to the one end of the drive shaft; a pair of wings disposed on opposite sides of the housing; a plunger slot formed in the housing; a plunger movably disposed in the plunger slot, the plunger including a central bore therein and a pair of tabs disposed on opposite sides of the plunger; and a compression spring disposed in the central bore in the plunger, the compression spring providing a force to bias the plunger towards the drive shaft housing.

7. The apparatus of claim 6 wherein one of the pair of tabs of the plunger engages the tab slot in the drive shaft housing in an out-of-battery position.

8. The apparatus of claim 6 wherein the opening in the housing has a generally square shape.

9. The apparatus of claim 6 wherein a plane containing the pair of wings and a plane containing the pair of tabs are substantially orthogonal to each other.

10. The apparatus of claim 6 further comprising a retainer attached to the housing for holding the plunger and spring in the plunger slot.

* * * * *